US005595154A

United States Patent [19]

Smith

[11] Patent Number: 5,595,154

[45] Date of Patent: Jan. 21, 1997

[54] ROTARY ENGINE

[76] Inventor: William A. Smith, Rte. 1, Box 213, Kinston, N.C. 28501

[21] Appl. No.: 387,602

[22] Filed: Feb. 13, 1995

[51] Int. Cl.[6] ..... F02B 53/00

[52] U.S. Cl. ..... 123/222; 123/232; 418/227

[58] Field of Search ..... 123/222, 232; 418/191, 196, 227

[56] References Cited

U.S. PATENT DOCUMENTS

| | | | |
|---|---|---|---|
| 1,003,263 | 9/1911 | Humphreys | 123/222 |
| 1,286,900 | 12/1918 | Ashcraft | 123/222 |
| 2,794,429 | 6/1957 | Walter | 418/191 |
| 4,083,663 | 4/1978 | Montalvo | 123/222 |

FOREIGN PATENT DOCUMENTS

| | | | |
|---|---|---|---|
| 2345991 | 4/1974 | Germany | 418/227 |
| 2258685 | 6/1974 | Germany | 123/222 |
| 66585 | 8/1943 | Norway | 123/222 |

*Primary Examiner*—Michael Koczo
*Attorney, Agent, or Firm*—Rhodes, Coats & Bennett, L.L.P.

[57] ABSTRACT

A rotary engine is provided with a rotary piston that is rotatively mounted within a housing. The rotary piston includes a surrounding circumferential edge that is provided with a series of distinct depressions formed therein. Formed in the housing outwardly of the rotary piston is a pair of valve housings with each valve housing including a rotary valve mounted therein. Each of the rotary valves are driven in time relationship to the rotary piston. As the rotary piston rotates within the housing, there is a series of chambers defined between respective depressions and the housing. Moreover, as the rotary piston and rotary valves rotate, they cooperate to form four separate chambers around the rotary piston, including combustion, exhaust, intake, and compression chambers. In the embodiment illustrated herein, for each revolution of the rotary piston, there are two compression, intake, exhaust and combustion cycles or phases.

9 Claims, 7 Drawing Sheets

ROTARY ENGINE

FIELD OF INVENTION

The present invention relates to internal combustion engines and more particularly to a rotary engine.

BACKGROUND OF THE INVENTION

The conventional reciprocating internal combustion engine has for decades been the standard power plant utilized by essentially all industries including the automotive industry. Although the reciprocating internal combustion engine has indeed met with continuous and substantial success over the years, from a purely design consideration the reciprocating internal combustion engine has shortcomings and drawbacks. For example, the reciprocating internal combustion engine includes many moving parts having very close tolerances. The basic layout and movement of the reciprocating pistons often make it expensive to balance. In the end, one finds the conventional reciprocating internal combustion engine relatively complex and difficult to repair, especially today.

For many years, designers and engineers have toyed with the idea of a rotary type combustion engine. For example, see the disclosures in the following U.S. Pat. Nos.: 1,003,263; 3,913,532; 4,057,035; 976,691; 1,071,342; 1,093,309; 1,136,344; and 1,226,745. Not only have inventors and designers toyed with the rotary engine concept, but to a limited degree, the rotary engine has been commercialized in the automotive industry. However, the commercial success of the rotary engine is small in comparison to the acceptance and use of the conventional reciprocating internal combustion engine. Still, the basic advantages of a rotary engine that results from purely design considerations still remain. Thus, there continues to be a need for a simple and effective rotary engine design.

SUMMARY AND OBJECTS OF THE INVENTION

The present invention entails a rotary engine that is designed to overcome the disadvantages and shortcomings of the conventional reciprocating internal combustion engine. In addition, the rotary engine design of the present invention entails a relatively simple design that should overcome the more basic problems and drawbacks associated with rotary engine designs of the prior art.

In that regard, the rotary engine of the present invention includes a rotary piston housed within a housing structure. The rotary piston includes opposed elliptical faces or cylindrical edges that have depressions formed therein. In addition, there is provided at least two opposed rotary valves mounted within the housing outwardly of the rotary piston. As the rotary piston and rotary valve rotate within the housing, there is defined between the outer circumferential edges of the piston and the housing a series of chambers referred to as combustion, exhaust, intake and compression chambers. In the embodiment disclosed herein, during each revolution of the rotary piston, there are two firings and consequently, there are two separate cycles or phases of compression, exhaust, intake and combustion.

It is therefore an object of the present invention to provide a relatively simple and reliable rotary engine design.

Another object of the present invention is to provide a rotary engine having a rotary piston having a series of spaced apart depressions formed in the circumferential edge of the piston wherein the depressions themselves form a part of separate and distinct chambers that exist around the exterior of the piston during the operation of the rotary engine of the present invention.

Still a further object of the present invention resides in the provision of a rotary engine of the character referred to above including a series of rotary valves that cooperate with the rotary piston and the depressions thereof to form during the operation of the engine at least four distinct chambers outwardly of the rotary piston but inwardly of a surrounding housing, the chambers being combustion, exhaust, intake and compression chambers.

Still a further object of the present invention resides in the provision of a rotary engine of the character referred to above wherein the rotary valve and the various depressions include one or more sealing rings disposed therearound and wherein during the operation of the rotary engine, the respective valves rotate and seal against the sealing ring or rings extending around the various depressions formed in the circumferential edge of the rotary piston.

Other objects and advantages of the present invention will become apparent and obvious from a study of the following description and the accompanying drawings which are merely illustrative of such invention.

DETAILED DESCRIPTION OF THE INVENTION

Figure 1:
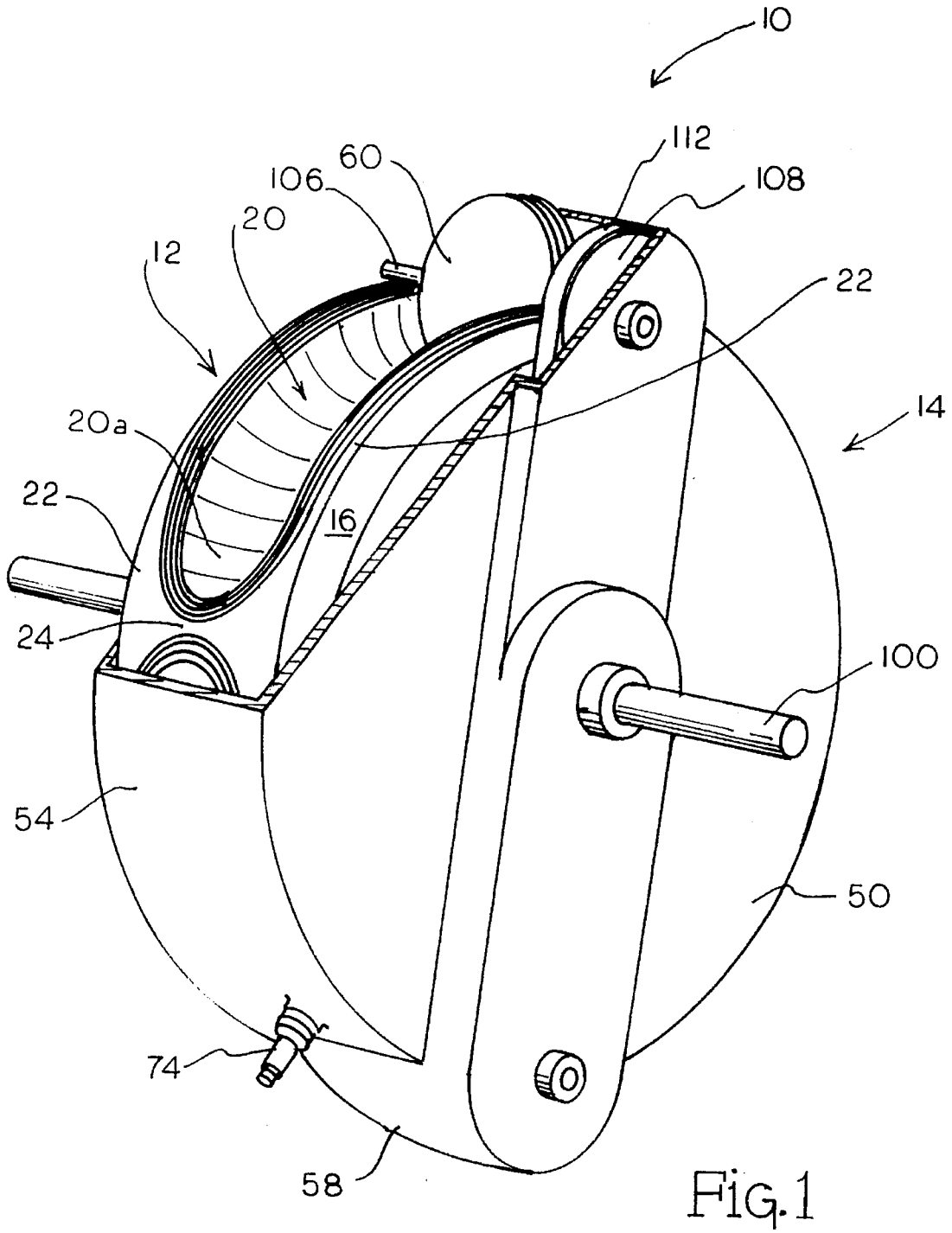
FIG. 1 is a perspective view the rotary engine of the present invention with portions of the housing broken away to better illustrate the internal structure of the engine.

With further reference to the drawings, the rotary engine of the present invention is shown therein and indicated generally by the numeral 10. Basically, the rotary engine 10 of the present invention includes an internal rotary mounted piston indicated generally by the numeral 12 that is enclosed within a surrounding housing structure indicated generally by the numeral 14. As will be more fully appreciated from subsequent portions of this disclosure, the rotary engine 10 is designed such that as the rotary piston 10 rotates within the housing 14 that an air-fuel mixture will be induced into the rotary engine and the air-fuel mixture will be compressed by the rotating piston after which the compressed air-fuel mixture will be fired and then exhausted. Thus, it is appreciated that as the rotary piston rotates within the housing structure 14, that there will be defined open areas or chambers between the rotary piston 12 and the housing 14 that will serve as an intake chamber, compression chamber, combustion chamber, and exhaust chamber.

Now, turning to a discussion of the rotary piston 12, it is seen that the same includes a pair of sides 16 and a surrounding circumferential edge.

In the case of the rotary piston 12 disclosed herein, there is provided a pair of depressions, indicated generally by the numeral 20, formed about opposite sides of the circumferential edge of the piston. Note that each depression 20 is elongated and tends to curve around the circumferential edge of the rotary piston. Each depression 20 includes a generally U-shaped transverse cross-sectional area (FIG. 2) which means that the respective depression 20 becomes progressively more shallow towards the opposed sides. In fact, in the design illustrated herein, each depression 20 includes opposed end areas 20*a* and as seen in the drawings as one moves from the central point of each depression towards opposed ends the depth of the depression becomes progressively shallower. Thus, each depression 20 includes a maximum depth approximately midway between opposed end areas 20*a* at a point that is generally midway the opposed sides of the depression.

Figure 3:
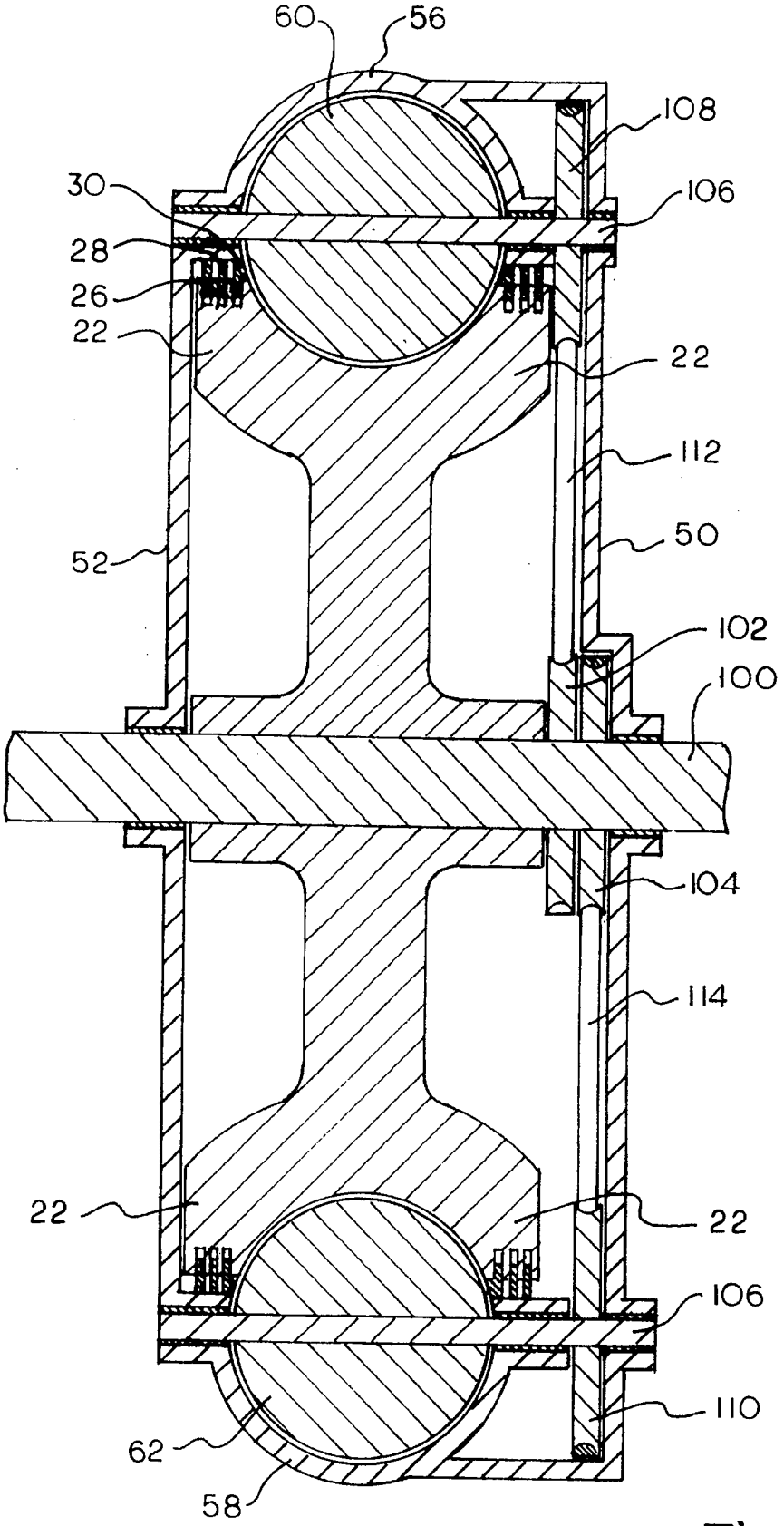
FIG. 3 is a vertical section taken through the rotary engine of the present invention.

Each depression 20 is bounded along the sides by opposed shoulders 22 (FIGS. 1 and 3). Disposed between the respective end areas of the two depressions 20 of the design disclosed herein is a pair of transition areas indicated by the numeral 24.

To seal each depression 20 with the interior of the housing 14, there is provided a series of sealing rings that extend completely around each depression. In particular, in the embodiment illustrated there is provided three spaced apart sealing rings, a primary compression ring 26, a secondary compression ring 28, and an inner oil ring 30. Note that each of the rings 26, 28 and 30 extend along each shoulder 22 and curve around opposed end areas 20*a* of each depression 20. Although the clearance between the respective rings and the housing 14 may vary, it is contemplated that the clearance would range from approximately 0.005 inch to 0.020 inch. Thus, it is appreciated that the area bounded by the sealing rings 26, 28 and 30 helps in defining an open chamber between each depression 20 and the opposed internal side 15 (FIG. 4) of the housing 14. Thus, as the rotary piston 12 is rotated within the housing 14, the sealing rings 26, 28 and 30 tend to isolate the area bounded by the sealing rings and the interior side 15 of the housing 14 that faces the respective depression 20.

Now, turning to the housing 14, it is seen that the same includes a pair of opposed sides 50 and 52 as well as a circumferential edge 54 that extends around the edge of the rotary piston. Formed in the housing 14 is a pair of valve housings 56 and 58. Each valve housing 56 and 58 is of a generally dome shape and is integrally formed with the circumferential edge 54 of the housing 14. In the embodiment illustrated herein, valve housing 56 is referred to as an intake/exhaust valve housing, while valve housing 58 is referred to as a compression/combustion valve housing. Each valve 60 or 62 includes opposed sides and a surrounding edge. A plurality of sealing rings are formed around the surrounding edge of each valve. In particular, each valve 60 and 62 includes a pair of compression rings 64 and a pair of oil rings 66. Note that the compression rings 64 are disposed outwardly of the oil rings 66.

Rotatively mounted within the respective valve housings 56 and 58 is a pair of rotary valves 60 and 62 that are driven in time relationship with respect to the rotary piston 12. In the embodiment disclosed herein, rotary valve 60 is an exhaust/intake valve while rotary valve 62 is a compression/combustion valve.

As discussed above, the rotary valves 60 and 62 are driven in time relationship with respect to the rotary piston 12. That is, for each revolution of the rotary piston 12, each valve 60, 62 will make one single revolution. To achieve the time driving relationship between the rotary piston 12 and the valves 60 and 62, there is provided a drive assembly associated with the rotary engine 10. In this regard, there is provided a drive shaft 100 that is secured to the rotary piston 12 and rotates therewith. A pair of transfer gears 102 and 104 are secured to drive shaft 100 about one side of the rotary piston 12. In addition, each valve 60 and 62 is rotatively mounted to a valve drive shafts 106 within a respective valve housing 56, 58. Secured to the respective drive shaft 106 is a pair of driven gears 108 and 110. To transfer the torque from drive shaft 100, there is provided a flexible drive member 112 which is trained around sheaves or gears 102 and 108 which results in rotary valve 60 being rotatively driven. Likewise, flexible drive member 114 is trained around the gear or sheave 104 as well as the gear or sheave 110 which results in the driving torque associated with drive shaft 100 being transferred to rotary valve 62. It is appreciated that the endless flexible driving members 112 and 114 could be either a flexible drive belt or a chain.

Formed adjacent valve housing 56, is an intake port 68. As will be appreciated from subsequent portions of the disclosure, intake port 68 is operative to channel an air-fuel mixture into an intake chamber within the rotary engine 10. Formed in the housing 14 on the opposite side of the valve housing 56 is a pair of exhaust ports 70. Note that one exhaust port 70 is formed in the cylindrical side wall of the housing 14 while the other exhaust port 70 is actually formed in the valve housing 56.

Formed on the opposite side of the housing 14, adjacent valve housing 58, is a spark plug port 72 and a spark plug 74. Spark plug 74 extends inwardly through the housing 14 and is effectively open to a combustion chamber, to be subsequently discussed, formed within the rotary engine 10.

Figure 2:
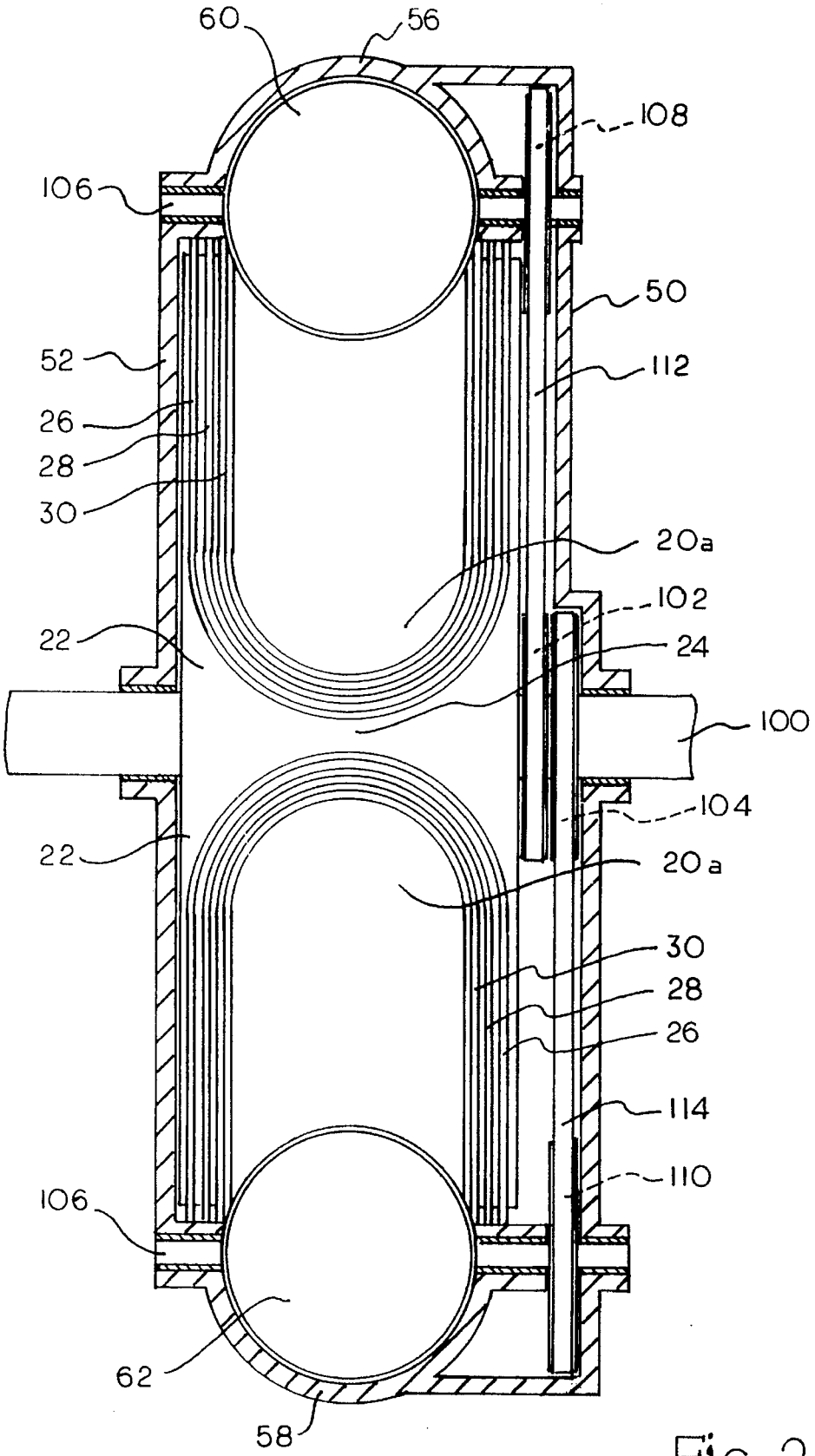
FIG. 2 is an elevational view of the rotary engine of the present invention with portions of the outer surrounding housing structure shown in section to better illustrate the internal structure thereof including the rotary piston and the rotary valves.
Figure 4:
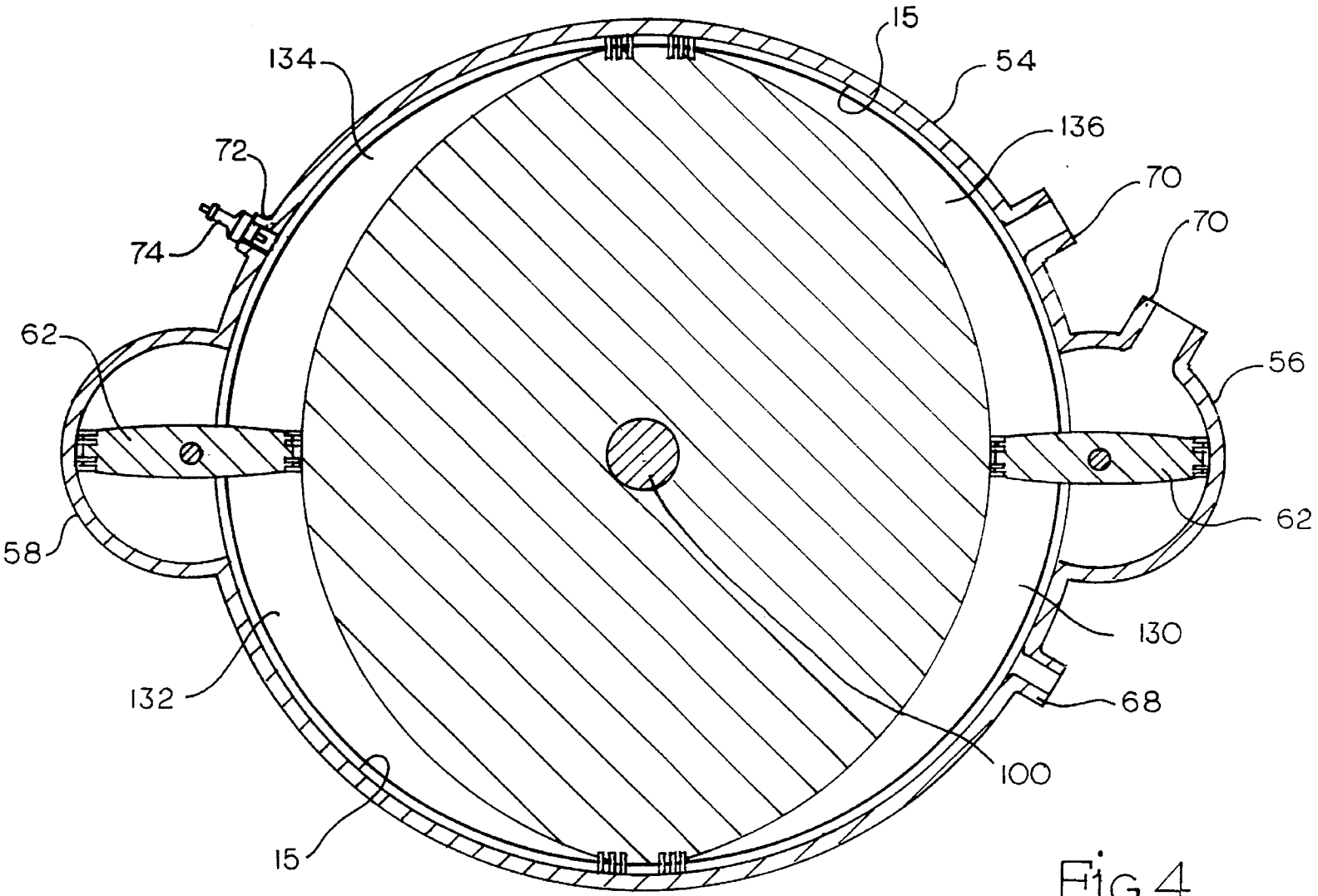
FIG. 4 is a side sectional view of the rotary engine of the present invention showing the rotary piston and the rotary valves forming a part thereof.
Figure 5:
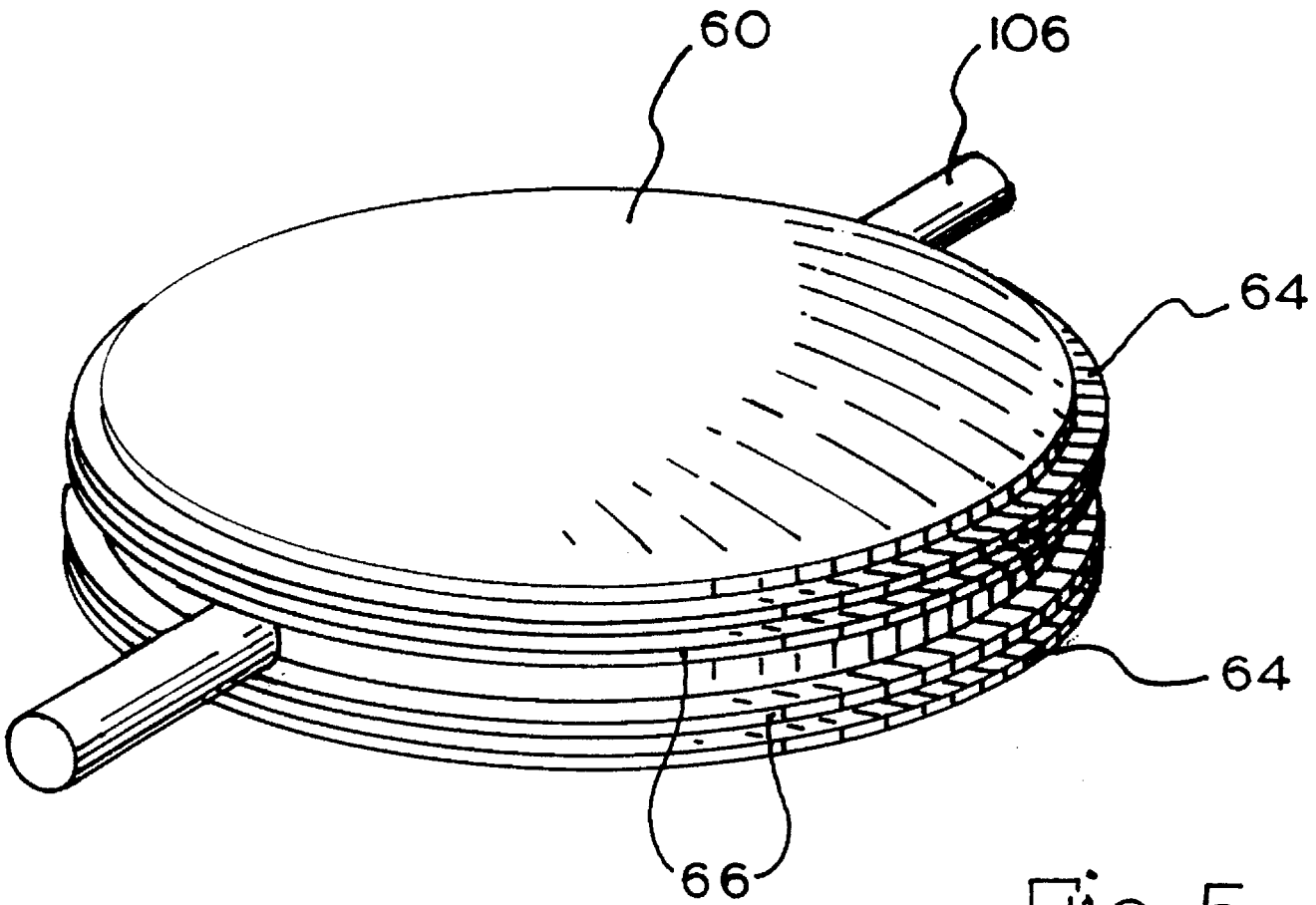
FIG. 5 is a perspective view of a rotary valve that forms a part of the rotary engine of the present invention.

As previously pointed out, the rotary engine 10 is operative to induce an air-fuel mixture into the housing 14 via an intake port 68 and then to compress that air-fuel mixture and fire the same and thereafter to exhaust the resulting combustion gases out either of the exhaust ports 70. Thus, as seen in FIGS. 2–4, the intake, compression, combustion and exhaust phases are all carried out in areas that are defined by the depressions 20 and the interior side 15 of the circumferential edge 54 of the housing 14. To illustrate this, reference is made to FIG. 4 where for purposes of explanation the rotary piston 12 and the rotary valves 60 and 62 are situated in what will be referred to as an initial position. Here, there are four distinct chambers defined around the rotary piston 12. First, there is an induction or intake chamber 130 that is formed in the lower right-hand quadrant of the rotary engine as viewed in FIG. 4. It is seen that the intake chamber 130 is essentially define by the intake/exhaust valve 60 and a portion of a depression 20 and the internal wall 15 of the housing 14. Note that the intake chamber 130 is sealed by the compression rings 64 of the rotary valve 60 which engage and seal against the valve housing 56 and the sealing rings 26, 28 and 30 of the adjacent depression 20. It is appreciated that the sealing rings, 26, 28 and 30, of the depression 22 seal against the internal wall 15 of the housing 14. Thus, the intake chamber 130 is essentially sealed except for the induction or intake port 68.

Proceeding clockwise around the rotary engine 10, the next chamber shown in FIG. 4 is the compression chamber 132. The compression chamber 132 in like fashion is sealed by the compression and combustion rotary valve 62 as well as the cooperative relationship of the left hand depression 20 (as viewed in FIG. 4) with the internal wall 15 of the housing 14. Again, note that the sealing rings, particularly the compression ring 64, of the rotary valve 62 seals against the valve housing 58 and the depression 20 formed in the surface of the rotary piston 12. As viewed in FIG. 4, rotary valve 62 extends downwardly into the generally U-shaped depression 20 to form a sealed relationship across the depression.

Continuing to move clockwise around the rotary piston 12, disposed in the upper left hand quadrant of the rotary engine 10 as viewed FIG. 4, is a combustion chamber 134. Combustion chamber 134 is formed in an area within the housing 14 that is bounded and defined by a portion of a depression 20, the internal face or wall 15 of housing 14, and the revolving compression/combustion rotary valve 62.

Finally, the last chamber is the exhaust chamber that is referred to by numeral 136 and is shown in the upper right hand quadrant of the rotary engine 10 shown in FIG. 4. The exhaust chamber 136 is defined and bounded by a portion of a depression 20, the internal face or wall 15 of the housing 14 and the revolving rotary intake exhaust valve 60.

Thus, as shown in FIG. 4, there are four distinct chambers, 130, 132, 134 and 136 disposed around the outside of the rotary piston 12 and internally within housing 14. It is seen that the rotary valves 60 and 62 play an important role in defining the respective chambers and isolating or separating one adjacent chamber from another. It is appreciated that the sealing rings 26, 28 and 30 which surround each depression 20 are maintained in sealing contact with the internal wall 15 of the housing 14 as the rotary piston 12 is rotated. Thus, the volume formed between the respective depressions 20 of the rotary piston 12 remain sealed as the rotary piston 12 rotates within the housing 14. The respective rotary valves 60 and 62 tend to divide respective depressions into two parts and consequently the respective chambers 130, 132, 134 and 136 effectively extend into a portion of the respective valve housings 56 and 58 during certain portions of the cycle. For example, as shown in FIG.4 and in this initial position, each valve housing 56 and 58 is essentially divided by its associated rotary valve 60 or 62 such that approximately one-half of the volume of the respective housing serve as a chamber for one of the basic phases of the combustion process.

As shown in FIG. 4, the rotary piston 12 as well as the respective rotary valves 60 and 62 are designed to rotate clockwise. As the rotary piston 12 rotates clockwise, the sealing rings (26, 28 and 30) surrounding each of the depressions 20 maintain a sealed relationship with the housing 14. In addition, as the rotary valves 60 and 62 rotate clockwise, they too maintain a sealed relationship with the respective valve housings as well as the adjacent passing depressions 20 formed in the outer edge of the rotary piston 12.

As the rotary piston 12 and the rotary valves 60 and 62 advance clockwise as viewed in FIG. 4, it is appreciated that the rotary valves 60 and 62 maintain a sealed relationship with the rotating depressions 20 formed in the rotary piston. It is appreciated that each of the depressions 20 become progressively more shallow towards the opposed end areas 20*a*. The depth of the respective depressions is particularly selected such that as the rotary piston 12 rotates and the respective rotary valves 60 and 62 wipe through the depressions 20 that a sealed relationship exists at the interface of the rotary valves and the depressions throughout each revolution of the rotary piston 12.

It is appreciated from reviewing the drawings that in the embodiment illustrated herein, the two depressions 20 are separated by two opposed transition areas 24. Basically, the transition areas 24 serve as a bridge between the respective depressions 20. Further, the transition areas 24 are generally round or concave with respect to the center of the rotary piston 12. As will be appreciated from subsequent portions of the disclosure, the respective rotary valves 60 and 62 will depart from contact with the rotary piston 12 and the depressions 20 as the transition areas 24 advance to a position generally adjacent the rotary valves 60 and 62.

Turning to FIGS. 6–13, there is shown a sequence of drawings showing the rotary engine 10 of the present invention moving through a complete cycle. A cycle is completed each time the rotary piston 12 and the rotary valves 60 and 62 make a complete revolution. In this sequence of drawings (FIGS. 6–13), the intake, compression, combustion and exhaust chambers are shown. In addition, the particular intake, compression, combustion and exhaust processes are illustrated. In this regard, the following symbols are used in FIGS. 6–13: Intake (–), compression (+), combustion (Δ) and exhaust (0).

Figure 6:
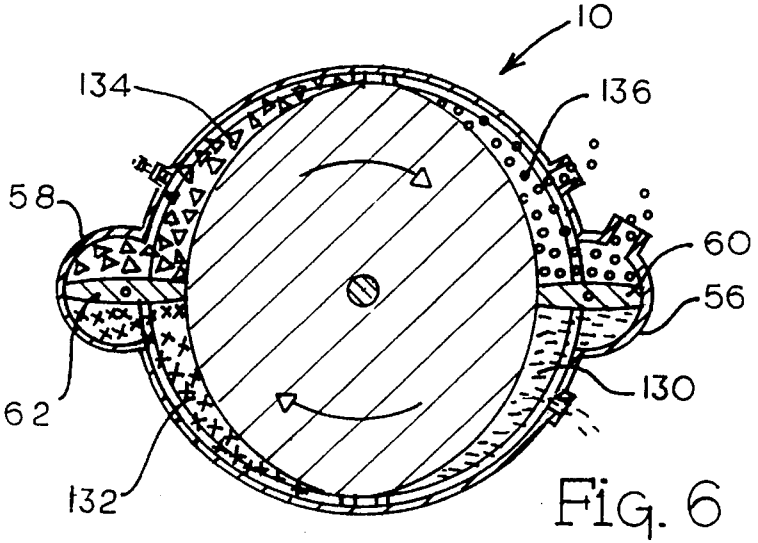

In FIG. 6, the rotary engine 10 is shown in a first or initial position. Note that the various chambers in this position are uniformly distributed around the rotary piston 12. In particular, the intake chamber 130 is disposed in the lower right-hand quadrant of the engine while the combustion chamber 132 is disposed in the lower left-hand quadrant of the engine. Continuing, the compression chamber 134 is disposed in the upper left-hand quadrant of the engine while the exhaust chamber 136 is disposed in the upper right-hand quadrant of the engine. Also, it is appreciated that the rotary piston 60 effectively divides the intake chamber 130 and the exhaust chamber 136. Likewise, rotary valve 62 effectively divides the compression chamber 132 and the combustion chamber 134. Note also that the respective chambers extend into portions of the valve housings 56 and 58. Thus, in the position shown in FIG. 6, the various chambers surrounding the rotary piston 12 includes not only the areas between the rotary piston 12 and the circumferential edge 54 of the housing 14 but also includes portions of the valve housings 56 and 58.

In the position shown in FIG. 6, the sealings rings 26, 28 and 30 surrounding each of the depressions 20 seal against the outer housing 14. The respective rotary valves 60 and 62 seal against the dome shaped valve housings 56 and 58. In addition, the rotary valves 60 and 62 project into and seal transversely across the depressions 20 formed in the rotary piston 12. Consequently, each of the chambers 130, 132, 134 and 136 is substantially sealed with respect to the other chambers.

Figure 7:
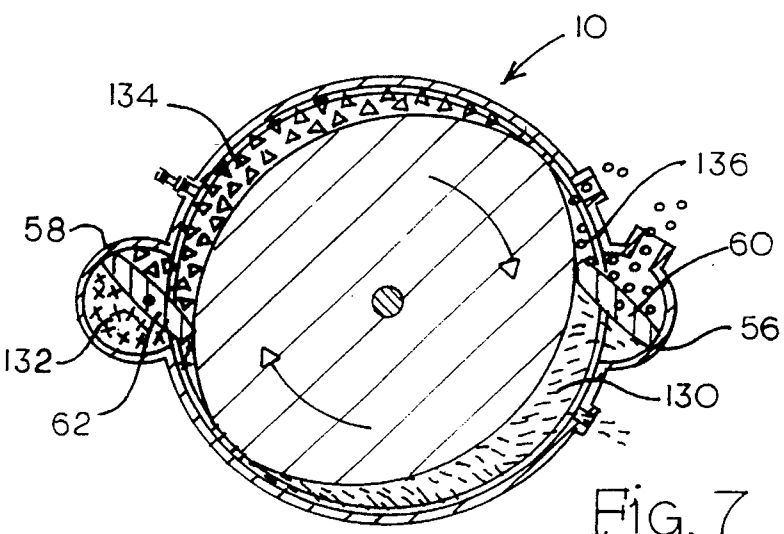
FIGS. 6–13 are a series of sequence views showing the rotary engine of the present invention moving through its various cycles or phases.

Turning to FIG. 7, note that the rotary piston 12 and the rotary valves 60 and 62 have advanced counter clockwise 45° degrees. In this position, one notes that the intake chamber 130 and the combustion chamber 134 have expanded, that is increased in volume. On the other hand, the compression chamber 132 and the exhaust chamber 136 have become smaller in volume. This obviously means that during the portion of the cycle between that shown in FIGS. 6 and 7 that the air-fuel mixture within the compression chamber 132 has been compressed. Also, note in FIG. 4 that the rotary valves 60 and 62 still play a major role in dividing and isolating the respective chambers as these valves maintain sealing contact with the opposed depressions 20.

Figure 8:
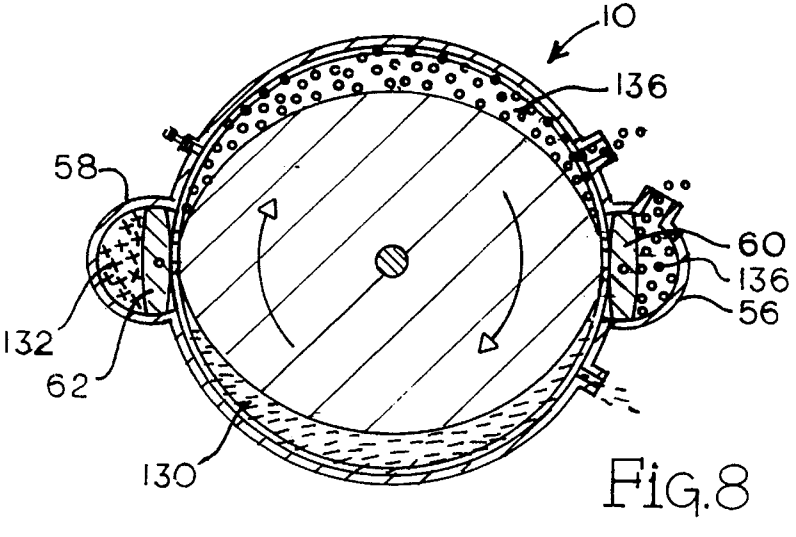
Figure 11:
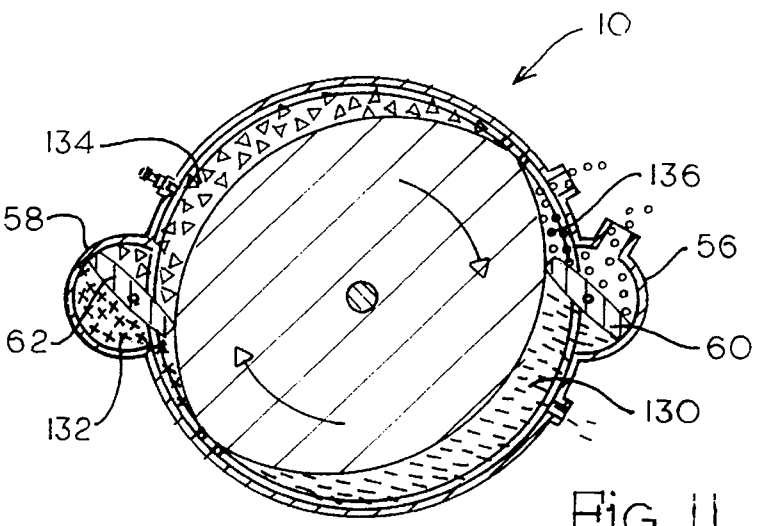

With reference to FIG. 8, the rotary engine 10 has now advanced another 45° degrees with respect to the position shown in FIG. 4. Note that the intake chamber 130 has continued to expand in volume to its maximum potential. Note also in FIG. 8 where the upper chamber is now open to at least one exhaust port and consequently, that upper chamber is now referred to as an exhaust chamber 136. While compressed gases may be present within the outer side of the valve housing 58, from a purely technical point of view combustion for this part of the cycle has been completed and the combusted gases are now housed within what is referred to as the exhaust chamber 136.

Figure 9:
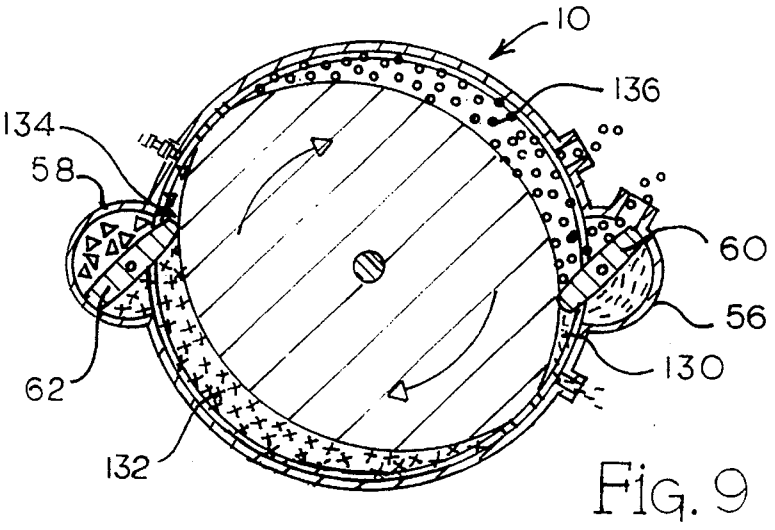

In FIG. 9, the rotary piston 12 and the rotary valves 60 and 62 have advanced another 45° degrees. In this position, one sees that the combustion chamber 134 is beginning to open. Also, a newly formed intake chamber 130 is likewise beginning to open. The former intake chamber assumes a compression state and in FIG. 9 one sees the first stages of compression. Also in FIG. 9 the combusted gases are being exhausted out the exhaust chamber 136 via exhaust ports 70.

Figure 10:
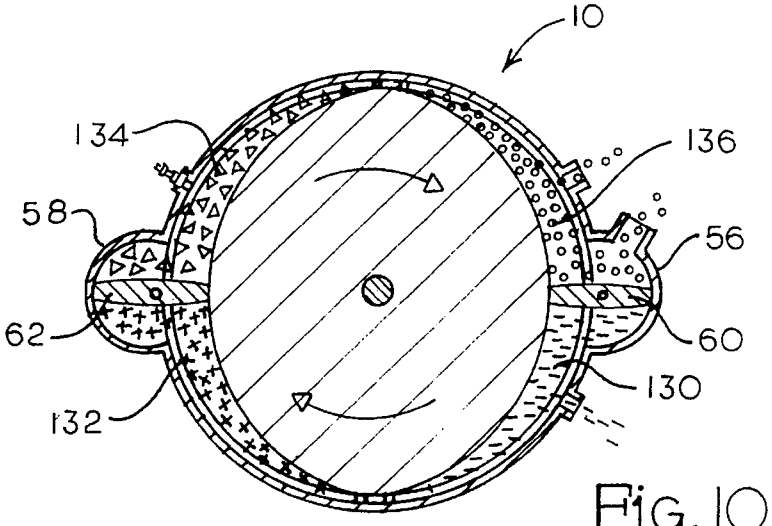
Figure 13:
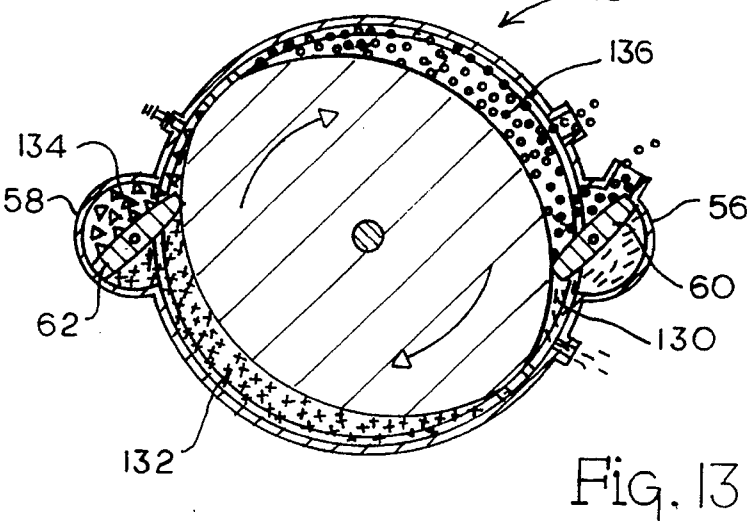
Figure 12:
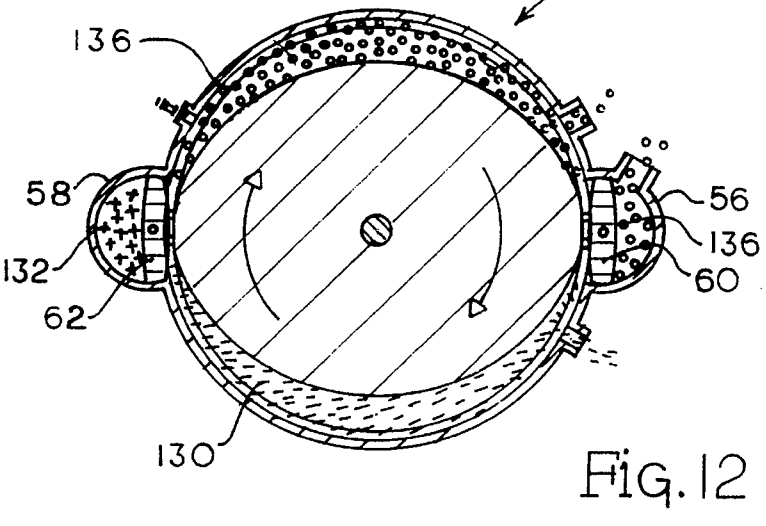

Turning to FIG. 10, the rotary piston 12 and the rotary valves 60 and 62 have advanced another 45° degrees and is positioned 180° degrees from the position shown in FIG. 6. However, the intake, compression, combustion and exhaust chambers depicted in FIG. 10 correspond with that shown in FIG. 6. Likewise, the position of the intake, compression, combustion and exhaust chambers shown in FIGS. 11, 12 and 13 conform to the positions shown in FIGS. 7, 8 and 9. Consequently, it is appreciated that for each cycle of the rotary engine (one revolution of the rotary piston 12 and rotary valves 60 and 62) that there are two firings as well as two intake, compression and exhaust phases.

Various approaches may be utilized to lubricate the rotary engine 10 of the present invention. In the way of an example, oil could be pumped through the shaft 106 associated with the rotary valves 60 and 62 and dispersed out the surrounding edge of the respective rotary valve.

Although the engine disclosed herein contains only one rotary piston 12, it is appreciated that any number of like rotary pistons could be secured along a common drive shaft 100 to form a single engine unit.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A rotary engine comprising:

a) an outer housing;

b) a rotary piston rotatively mounted within the housing and including an outer surrounding edge having a pair of depressions formed in the surrounding edge and wherein there is formed a chamber area between the respective depressions and the housing as the rotary piston rotates within the housing;

c) the outer housing including a pair of circumferentially spaced dome-shaped valve housings integrally formed therewith, with each dome-shaped valve housing being open to the rotary piston;

d) a rotary valve rotatively mounted in each dome-shaped valve housing with the rotary valve being rotatively mounted about an axis parallel with the axis of the rotary piston;

e) wherein one rotary valve constitutes an exhaust/intake valve while the other rotary valve constitutes a compression/combustion valve;

f) at least one sealing ring extending around each depression formed in the rotary piston with the sealing ring of each depression sealing against the outer housing during a substantial portion of each revolution of the rotary piston;

g) at least one sealing ring extending around each rotary valve for sealing with a respective dome-shaped valve structure as well as the sealing rings associated with each depression of the rotary piston and h) drive means interconnecting the rotary piston with the rotary valve for continuously driving the rotary valve in response to the rotation of the rotary piston such that the rotary valve is continuously driven as the rotary piston rotates within the outer housing.

2. The rotary engine of claim 1 wherein each depression is elongated and generally curves around a portion of the surrounding edge of the rotary piston.

3. The rotary engine of claim 2 wherein each depression is surrounded about opposite sides by a shoulder and wherein each depression includes opposed end areas.

4. The rotary engine of claim 3 wherein the depth of each depression varies throughout the depressions such that the depth generally becomes more shallow towards the opposed ends of the depression.

5. The rotary engine of claim 3 wherein the transverse cross-sectional area of each depression is arcuately shaped such that the depth of each depression becomes progressively more shallow towards the side shoulder extending adjacent the respective sides of each depression.

6. The rotary engine of claim 1 wherein there is provided a plurality of sealing rings extending around each depression and wherein the sealing rings maintain continuous contact with the outer housing as the rotary piston rotates therein.

7. The rotary engine of claim 6 wherein said plurality of sealing rings extending around each depression includes an outer primary compression ring, an intermediate secondary compression ring, and an inner oil ring.

8. The rotary engine of claim 1 wherein the rotary valve maintains intermittent contact with the rotary piston during each revolution of the rotary piston such that the rotary valve engages and seals against the rotary piston during a portion of each revolution while during another portion of the revolution the rotary valve is actually spaced from the rotary piston and does not engage and seal against the same.

9. The rotary engine of claim 1 wherein there is provided a pair of rotary valves for each rotary piston and wherein the pair of rotary valves and their associated dome shaped housings are disposed on opposite sides of the rotary piston.

* * * * *